US006169871B1

(12) United States Patent
Higaya

(10) Patent No.: US 6,169,871 B1
(45) Date of Patent: Jan. 2, 2001

(54) FIXING APPARATUS WITH IMPROVED FIXING EFFICIENCY

(75) Inventor: Toshiaki Higaya, Kawasaki (JP)

(73) Assignee: Ricoh Company, Ltd., Tokyo (JP)

( * ) Notice: Under 35 U.S.C. 154(b), the term of this patent shall be extended for 0 days.

(21) Appl. No.: 09/281,936

(22) Filed: Mar. 31, 1999

(30) Foreign Application Priority Data

Mar. 31, 1998 (JP) ..... 10-086611
Mar. 31, 1998 (JP) ..... 10-086612
Jan. 29, 1999 (JP) ..... 11-021992

(51) Int. Cl.[7] ..... G03G 15/20
(52) U.S. Cl. ..... 399/330; 219/619; 399/333
(58) Field of Search ..... 399/330, 333, 399/328; 219/216, 619, 618, 600, 469; 118/60; 432/60

(56) References Cited

U.S. PATENT DOCUMENTS

| | | | | |
|---|---|---|---|---|
| Re. 36,124 | | 3/1999 | Yokoyama et al. | 399/330 |
| 3,772,492 | * | 11/1973 | Brogden et al. | 219/619 |
| 4,011,641 | * | 3/1977 | Kitano et al. | 219/619 X |
| 5,426,495 | | 6/1995 | Sawamura et al. | 399/331 |
| 5,594,540 | | 1/1997 | Higaya et al. | 399/326 |
| 5,832,354 | | 11/1998 | Kouno et al. | 399/330 |
| 5,870,660 | * | 2/1999 | Ito et al. | 399/330 |
| 5,987,295 | * | 11/1999 | Matsuo et al. | 399/330 |
| 6,005,594 | * | 12/1999 | Nanataki et al. | 399/333 X |
| 6,026,273 | * | 2/2000 | Kinouchi et al. | 399/328 |
| 6,054,677 | * | 4/2000 | Morigami et al. | 219/216 |

FOREIGN PATENT DOCUMENTS

| | | |
|---|---|---|
| 61-24994 | 7/1986 | (JP) . |
| 9-160415 | 6/1997 | (JP) . |
| 10-184662 | 7/1998 | (JP) . |

* cited by examiner

*Primary Examiner*—Sophia S. Chen
(74) *Attorney, Agent, or Firm*—Oblon, Spivak, McClelland, Maier & Neustadt, P.C.

(57) ABSTRACT

An induction heating fixing apparatus including a heating roller having an outer cylinder, a coil arranged inside the outer cylinder to generate an induction magnetic flux, and a first insulating cylinder member arranged between the outer cylinder and the coil. A second insulating cylinder member is provided coaxial arrangement with the first insulating cylinder member and includes a spiral rib in substantially tight contact with the first insulating cylinder member to remove heat from the inside of the heating roller during rotation of the second insulating cylinder member. The coil is wound on a tubular member having an outer circumferential surface provided with radial holes which communicate with the interior of the tubular member and thereby to outside of the heating roller also to remove heat from the heating roller.

14 Claims, 8 Drawing Sheets

FIXING APPARATUS WITH IMPROVED FIXING EFFICIENCY

CROSS REFERENCE TO RELATED APPLICATIONS

This application claims benefit of priority to Japanese Patent Application Nos. 10-086611 filed Mar. 31, 1998; 10-086612 filed Mar. 31, 1998; and 11-021992 filed Jan. 29, 1999, the entire contents of which are incorporated by reference herein.

BACKGROUND OF THE INVENTION

1. Field of the Invention

The present invention relates to a fixing apparatus having a heating roller using an induction heating system.

2. Discussion of the Background

A known fixing apparatus used for image forming apparatuses such as a photocopying machine, a printer, and a facsimile, includes a heating roller using an induction heating system. In general in such a fixing apparatus having an induction coil is installed inside of a cylinder which forms the circumference of the heating roller, and an induction magnetic flux is generated by sending a high frequency alternating current to the induction coil. An induction current is generated in an electroconductive layer of the cylinder of the heating roller by the induction magnetic flux, and the heating roller is heated by joule heat generated by the induction current.

Because the induction coil is installed inside the heating roller, the fixing apparatus having the heating roller using the induction heating system has a problem in that the temperature of the induction coil is raised by radiant heat emitted from the cylinder of the roller and heated beyond a heat-proof temperature of the insulating cover of the coil. The fixing apparatus having the heating roller using the induction heating system has another problem in that fixing efficiency is not good, because heat generated in the cylinder of the heating roller is dispersed in the inside of the heating roller.

SUMMARY OF THE INVENTION

Accordingly, an object of this invention is to overcome the above-described and other problems with background apparatuses, by providing a fixing apparatus having a heating roller using an induction heating system, which is capable of preventing temperature rise of an induction coil and improving fixing efficiency.

This and other objects are achieved according to a preferred embodiment of the present invention by providing a novel fixing apparatus having a heating roller using an induction heating system, and which includes an insulating member arranged between a cylinder of the heating roller that is the heating unit of the heating roller and a coil arranged inside the cylinder to generate an induction magnetic flux.

According to the invention, the insulating member may further include a heat-absorbing member on the outer surface of the insulating member.

According to another preferred embodiment, in a fixing apparatus having a heating roller using an induction heating system, a tubular member on which a coil is wound to generate an induction magnetic flux is arranged inside the heating roller and an outer circumferential surface of the tubular member communicates with the outside of the heating roller by a plurality of openings provided in the tubular member.

Further, in a fixing apparatus having a heating roller of an induction heating system, according to still another embodiment of the present invention, an insulating cylinder member is provided inside a cylinder of the heating roller substantially tightly contacting the inner circumference of the cylinder. The length of the insulating cylinder member in the axial direction of the cylinder member may be made longer than the length of the cylinder of the heating roller in the axial direction of the cylinder.

In addition, a spiral rib may be provided on the insulating cylinder member such that an upstream pitch of the spiral rib is shorter than a downstream pitch of the spiral in the direction of air flow caused by the rib when the cylinder member is rotated.

Furthermore, at least one additional insulating cylinder member may be provided inside the insulating cylinder member substantially tightly contacting the cylinder. The lengths of the insulating cylinder member contacting the cylinder and the at least one additional insulating cylinder member in respective axial directions may be made larger than the length of the cylinder of the heating roller in the axial direction of the cylinder.

Furthermore, an optional cylinder member among the at least one additional insulating cylinder member may be configured to rotate integrally with the cylinder of the heating roller and a spiral rib may be provided on the rotative cylinder member.

BRIEF DESCRIPTION OF THE DRAWINGS

A more complete appreciation of the present invention and many of the attendant advantages thereof will be readily obtained as the same becomes better understood by reference to the following detailed description thereof when considered in conjunction with the accompanying drawings, wherein.

DETAILED DESCRIPTION OF PREFERRED EMBODIMENTS

Figure 1:
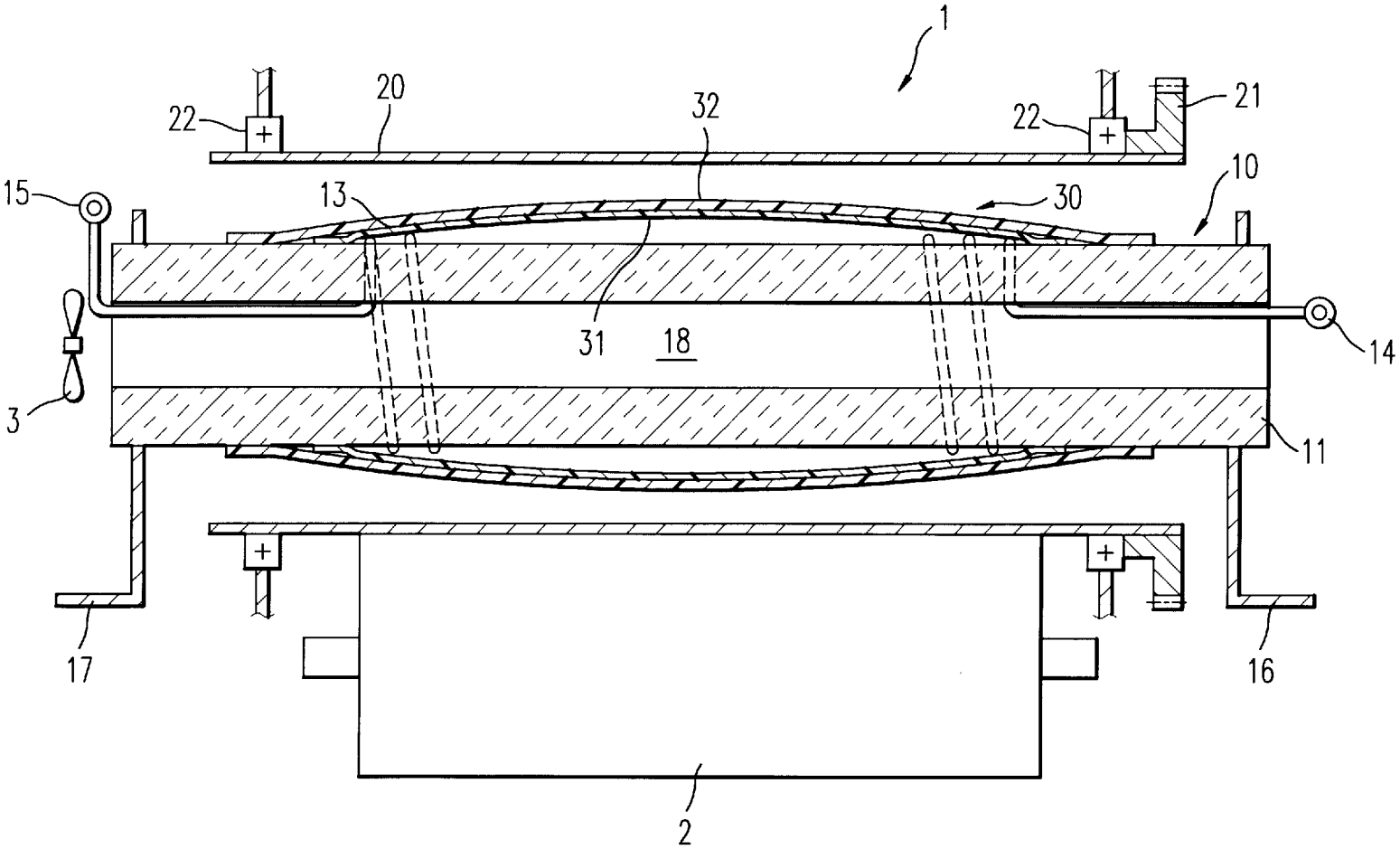
FIG. 1 is a schematic sectional drawing illustrating the main part of a fixing apparatus according to an embodiment of the present invention.

Next, preferred embodiments of the present invention will be described with reference to attached drawings, wherein like reference numerals designate identical or corresponding parts throughout several views.

FIG. 1 is a sectional outlined view showing the main part of a fixing apparatus according to an embodiment of the present invention. In this figure, a pressurizing roller 2 is pressed to a heating roller 1 of the fixing apparatus. The heating roller I uses an induction heating system and includes a cylinder 20 forming the circumference of the roller I and a core unit 10 provided inside of the cylinder 20.

The cylinder 20 forming the circumference of the roller 1 is made of a magnetic material such as, for example, stainless steel or iron, and is rotatively supported by bearings 22 and 22. A gear 21 is engaged and fixed to the end of the cylinder 20 and meshed with a driving gear (not shown) to receive a driving force such that the cylinder 20 of the roller 1 is rotated. A release layer including a fluorine resin is provided on the outside surface of the cylinder 20.

The core unit 10 installed inside of the cylinder 20 of the heating roller 1 includes a fixing shaft 11, and an induction coil 13 wound around the fixing shaft 11, and leads 14 and connected to the induction coil 13. The induction coil 13 receives a high frequency current from a power source (not shown) via the leads 14 and 15. The fixing shaft 11 is held with brackets 16 and 17 installed on a side board (not shown) of the fixing apparatus and is not rotative.

The fixing shaft 11 on which the induction coil 13 is wound has a through hole 18 penetrating the center thereof in the axial direction of the shaft 11. In addition, a cooling fan 3 is installed outside of the shaft 11 at one side near the end of the through hole 18. The cooling fan may be omitted, if the fixing shaft 11 can be resistant to the maximum temperature of the induction coil 13, such as for example, 300° C. In this embodiment, the fixing shaft 11 is made from a resin or ceramics. Further, an insulating unit 30 is installed covering the induction coil 13 of the core unit 10. The insulating unit 30 includes an insulating member 31 including, for example, a heat resistant resin, and a heat absorbing member 32, such as for example, a felt member, which is installed around the outer circumference of the insulating member 31. For the insulating member 31, a heat constriction tube made of silicon rubber or silicon rubber containing fluorine resin, or a heat resistance member made of silicon rubber or a fluorine resin, may be used. The insulating member 31 is installed tightly contacting the upper surface of the induction coil 13. The felt member 32 is adhered to the insulating member 31 with a heat resistant adhesive. In this embodiment, belt member 32 is a felt-like felt spirally wound around the outside of the insulating member 31. Besides, in this embodiment, both ends of the felt member 32 are located outside of both sides of the insulating member 31 (outside in the axial direction of the shaft 11 of the roller 1) and these felt ends are adhered to the fixing shaft 11 with PPS resin.

In the fixing apparatus constituted as described above, an induction magnetic flux is generated by supplying a high frequency current to the induction coil 13 of the core unit 10 and an induction current is sent to the cylinder 20 made of a magnetic material by the induction magnetic flux. Joule heat is generated in the cylinder 20 by the induction current and thereby the cylinder 20 is heated.

Figure 2:
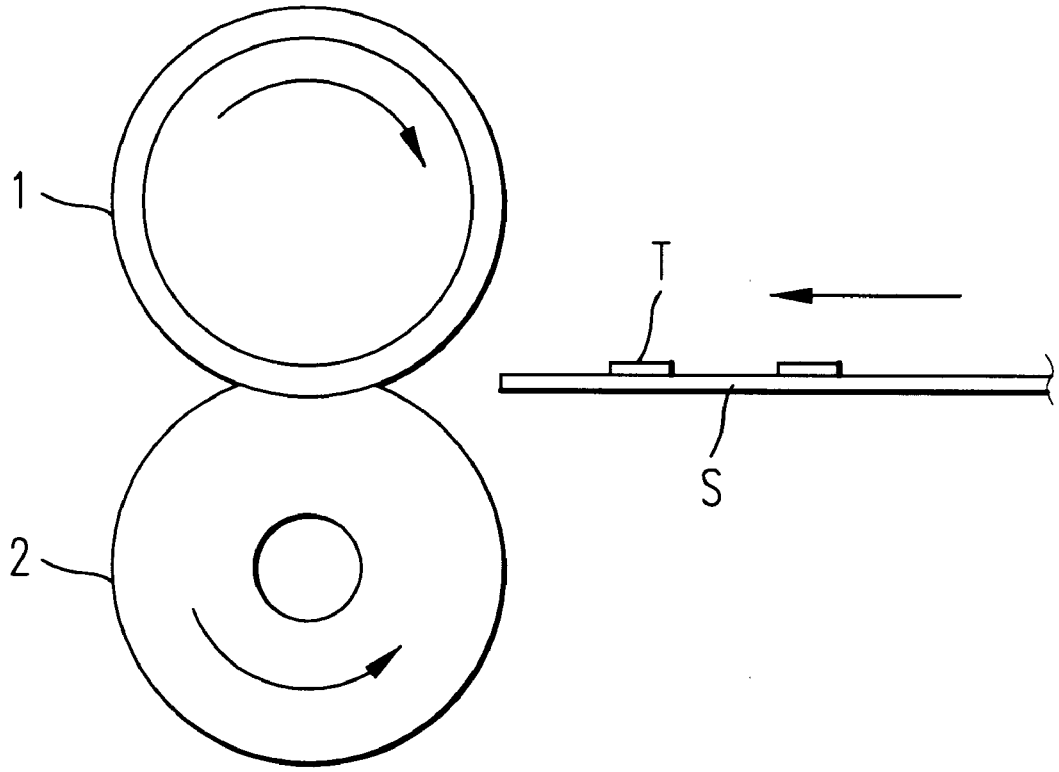
FIG. 2 is a schematic drawing illustrating a fixing operation of the fixing apparatus.

As illustrated in FIG. 2, the heating roller 1 is rotatively driven clockwise and the pressurizing roller 2 is pressed to the heating roller 1 to be rotated counterclockwise. A recording sheet S on which a toner image T is loaded for fixing is fed between the heating roller 1 and the pressurizing roller 2 and is conveyed from the right-hand direction to the left-hand direction in the figure, and the toner image T is fixed on the recording sheet S by heat and pressure. In FIG. 2, illustration has been omitted for the core unit 10 and the insulating unit 30 inside the heating roller 1. In the background heating roller using an induction heating system, when the heating roller is heated, the temperature of the induction coil may rise gradually due to a radiated heat arrived from the cylinder of the heating roller up to a temperature to break an insulation film of the coil. In the above embodiment, when the heating roller I is heated by a fixing operation, the temperature of the inside surface of the cylinder 20 rises up to about 180-200° C. and a radiant heat is emitted from the internal surface of the cylinder 20 to the inside of the cylinder 20. However, in this embodiment, the insulating unit 30 is installed covering the induction coil 13 of the core unit 10 of the heating roller 1 and the insulating member 31 of the insulating unit 30 reduces the effect of radiated heat from the cylinder 20 to the coil 13. Therefore, temperature rise of the induction coil 13 can be prevented and also a defect causing breakdown of the insulating film of the coil 13 can be prevented.

In addition, the outer circumferential surface of the insulating member 31 has the felt 32 as a heat absorbing member which reduces the effect of heat on the induction coil 13 by absorbing heat arriving from the cylinder 20 of the heating roller 1. In addition, the heat absorbing member 32 prevents temperature fall of the cylinder 20 of the heating roller I to increase fixing efficiency.

Further, in the embodiment, the insulating unit 30 is installed tightly contacting the induction coil 13 of the core unit 10. Thus, a gap between the core unit 10 and the cylinder 20of the heating roller I can be made small, such as for example, 3 min, and thereby the cylinder 20 can be heated efficiently by the induction coil 13, and as a result the start-up time of the apparatus can be shortened.

Next, another embodiment of a fixing apparatus according to the present invention is described below.

Figure 3:
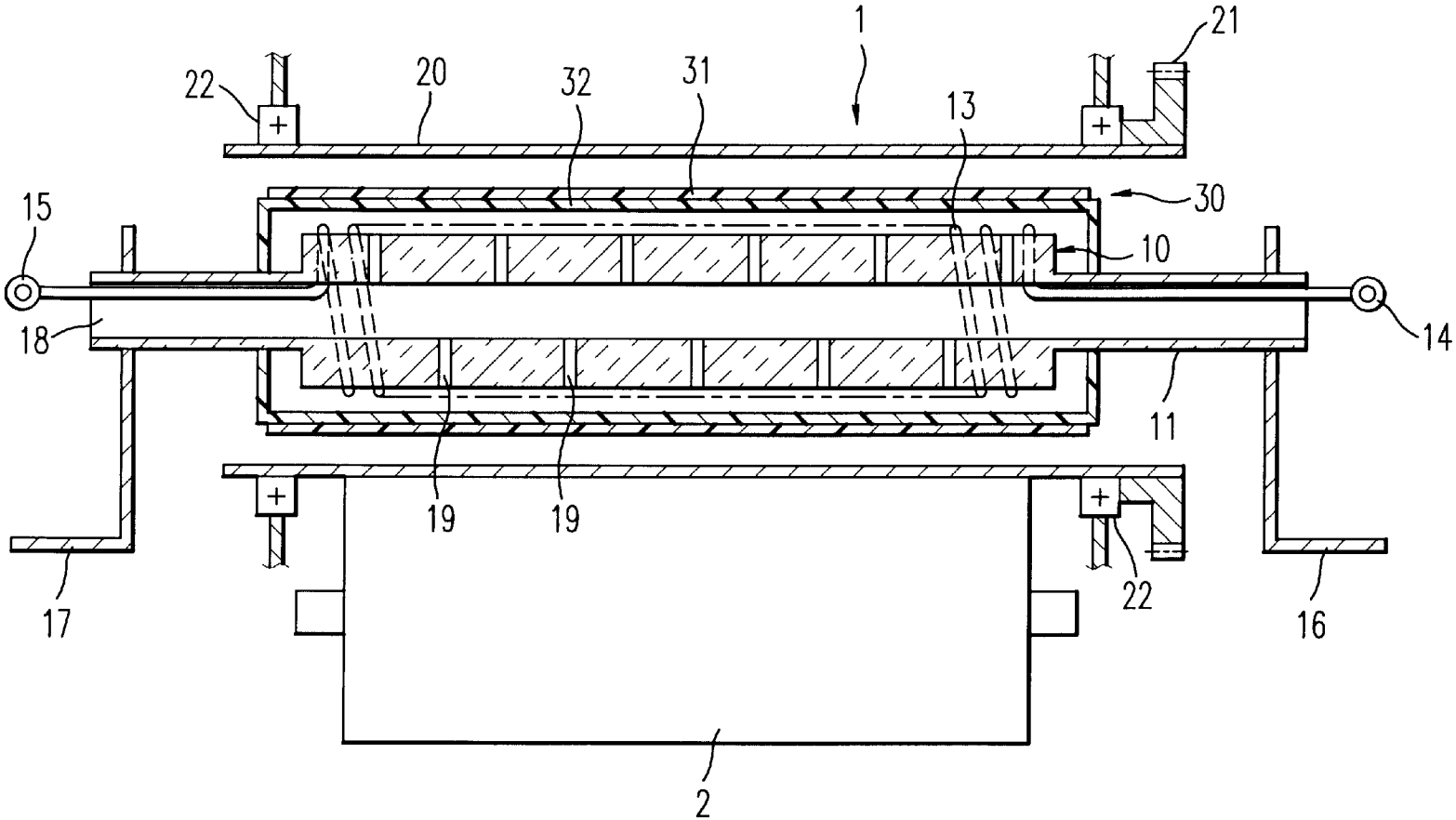
FIG. 3 is a schematic sectional drawing illustrating the main part of a fixing apparatus according to another embodiment of the present invention.
Figure 4:
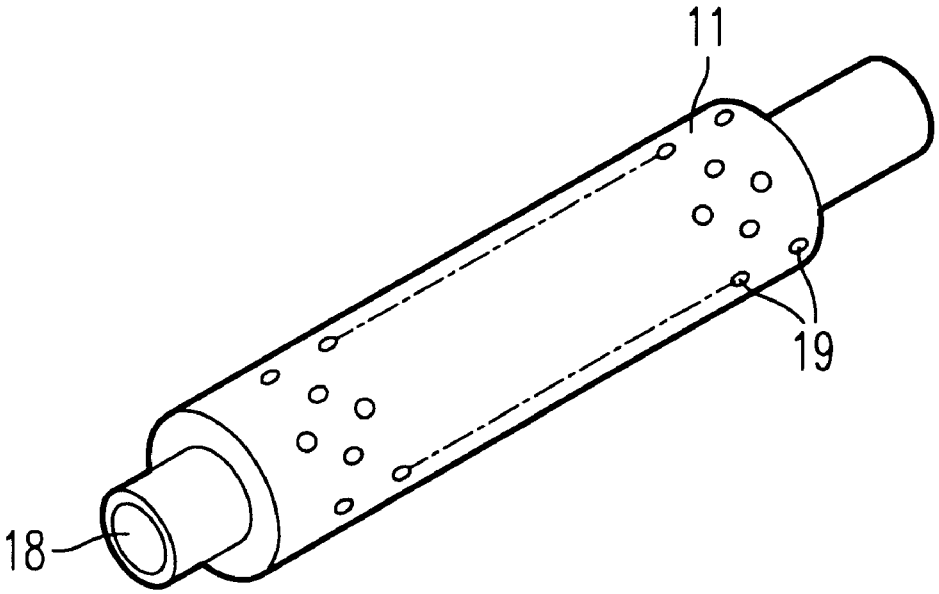
FIG. 4 is a perspective side view of a fixing shaft (bobbin) of the heating roller of the fixing apparatus illustrated in FIG. 3.

In the embodiment illustrated in FIG. 3 and FIG. 4, the pressurizing roller 2 is pressed to the heating roller 1 of the fixing apparatus. The heating roller 1 uses the induction heating system, and a core unit 10 is installed inside a cylinder 20 of the roller 1. Besides, an insulating unit 30 is installed covering the core unit 10. The cylinder 20 which forms the circumference of the heating roller 1 is made of a magnetic material such as, for example, stainless steel or iron, and is rotatively supported by bearings 22 and 22. A gear 21 is engaged and fixed to the end of the cylinder 20 and meshed with a driving gear (not shown) to receive a driving force such that the cylinder 20 of the roller 1 is rotated. A release layer including a fluorine resin is provided on the outside surface of the cylinder 20.

The core unit 10 installed inside the cylinder 20 of the heating roller 1 includes a fixing shaft 11, an induction coil 13 wound around the fixing shaft 11, and leads 14 and 15 connected to the induction coil 13. The induction coil 13 receives a high frequency current from a power source (not shown) via the leads 14 and 15. The fixing shaft 11 is held with brackets 16 and 17 installed on a side board (not shown) of the fixing apparatus and is not rotative.

As illustrated in FIG. 3 and FIG. 4, the fixing shaft 11 on which the induction coil 13 is wound has a through hole 18 penetrating the center thereof in the axial direction of the shaft 11 and a plurality of connecting holes 19 connecting the central through hole 18 to the outer circumference of the fixing shaft 11.

The insulating unit 30 includes an insulating cylinder member 31 which is made of, for example, a heat resistant resin, and a felt member 32 which is a heat absorbing member, installed around the outer circumferential surface of the cylinder member 31. The cylinder member 31 is substantially in tight contact with the fixing shaft 11 via the induction coil 13 which is wound around the fixing shaft 11.

In the fixing apparatus as above constituted, an induction magnetic flux is generated by supplying a high frequency current to the induction coil 13 of the core unit 10 and an induction current is induced in the cylinder 20 made of a magnetic material by the induction magnetic flux. Joule heat is generated in the cylinder 20 by the induction current and the cylinder 20 is thereby heated.

As illustrated in FIG. 2, the heating roller 1 is rotatively driven clockwise and the pressurizing roller 2 is pressed to the heating roller 1 to be rotated counterclockwise. A recording sheet S on which a toner image T is loaded for fixing is fed between the heating roller 1 and the pressurizing roller 2 and is conveyed from the right-hand direction to the left-hand direction in FIG. 2, and the toner image T is fixed on the recording sheet S by heat and a pressure. In the FIG. 2, illustration has been omitted of the core unit 10 and the insulating unit 30 inside the heating roller 1.

In the heating roller using an induction heating system, when the heating roller is heated, the temperature of the induction coil may rise gradually due to heat radiated from the cylinder 20 of the roller up to a temperature to cause breakdown of an insulating film of the coil. In the above embodiment of the present invention, when the heating roller 1 is heated by a fixing operation, the temperature of the inside surface of the cylinder 20 rises up to about 180–200° C. and a radiant heat is emitted from the inside surface of the cylinder 20 to the inside of the cylinder 20.

However, in the above embodiment, the fixing shaft 11 of the core unit 10 has a central through hole 18 and a plurality of connecting holes 19 connecting the central through hole 18 to the outer circumference of the fixing shaft 11. The induction coil 13 is wound around such fixing shaft 11 in an appropriate interval. With this configuration, heat around the coil 13 can be released via the connecting hole 19 and the central through hole 18 to the outside of the heating roller 1, the coil 13 can be thereby cooled, and temperature rise of the induction coil 13 when heating the heating roller 1 can be prevented.

Furthermore, in this embodiment, the insulating unit 30 is installed covering the core unit 10. The cylinder member 31 of the insulating unit 30, which is made of a heat resistant resin, reduces the effect of radiated heat from the cylinder 20 of the heating roller 1 to the coil 13, and prevents heated air inside the roller I from flowing in the core unit 10. Therefore, temperature rise of the induction coil 13 can be surely prevented and a defect such as breakdown of an insulating film of the coil 13 can be prevented.

Furthermore, the felt member 32 serving as a heat absorbing member is adhered to the surface (outer circumferential surface) of the cylinder member 31 to reduce the effect of heat on the induction coil 13 by absorbing the heat radiated from the cylinder 20 of the heating roller 1.

Thus, in the fixing apparatus of the above embodiment, temperature rise of the induction coil 13 and a defect such as breakdown of an insulating film of the coil 13 are surely prevented.

Next, another embodiment of a fixing apparatus according to the present invention is described below with reference to FIG. 5.

Figure 5:
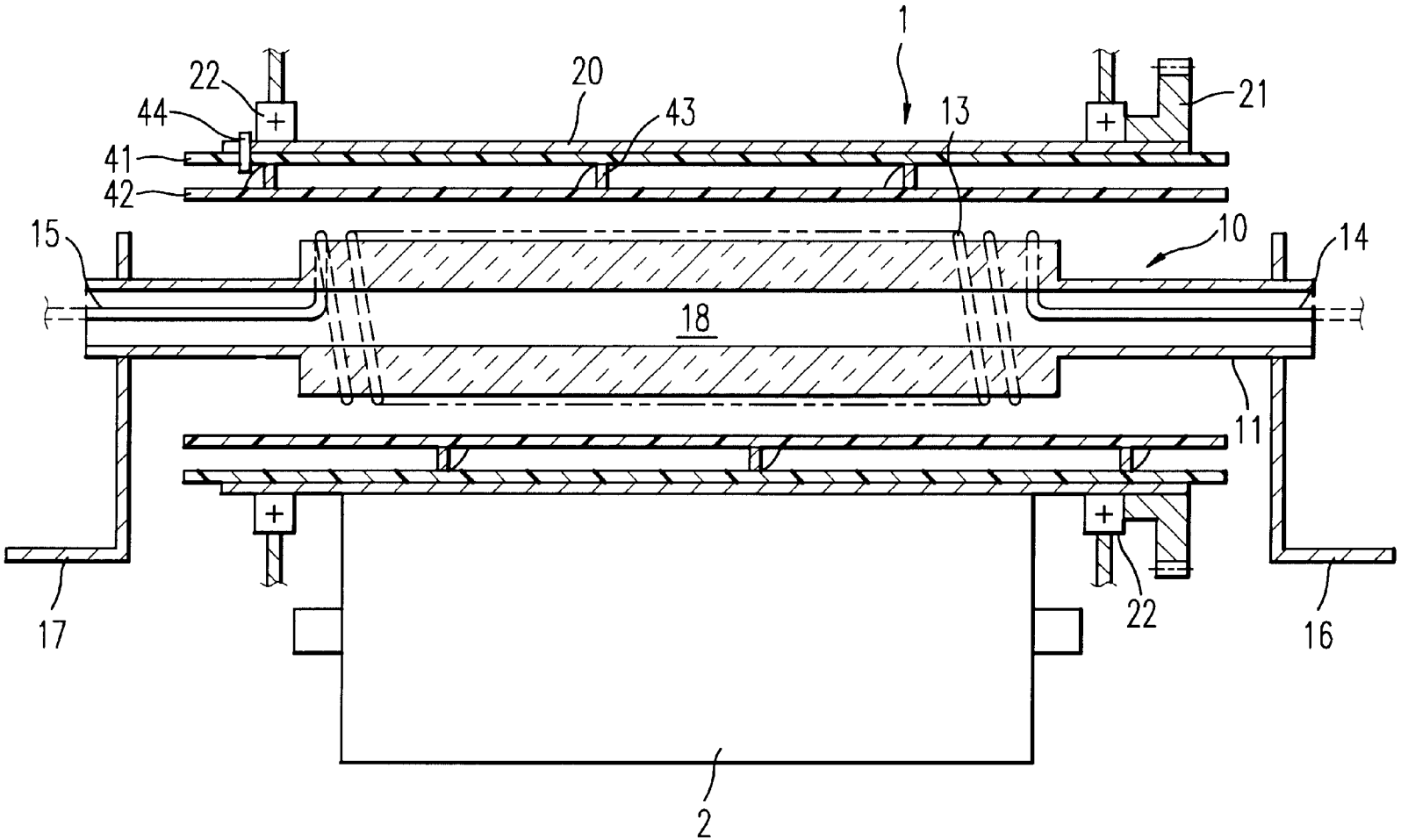
FIG. 5 is a schematic sectional drawing illustrating a fixing apparatus according to still another embodiment of the present invention.

In FIG. 5, the pressurizing roller 2 is pressed to the heating roller 1 of the fixing apparatus. The heating roller 1 using an induction heating system has a core unit 10 inside a cylinder 20 of the roller 1.

The cylinder 20 which forms the circumference of the heating roller 1 is made of such magnetic material as, for example, stainless steel or iron, and is rotatively supported by bearings 22 and 22. A gear 21 is engaged and fixed to the end of the cylinder 20 and meshed with a driving gear (not shown) to receive a driving force such that the cylinder 20 of the roller I is rotated. A release layer including a fluorine resin is provided on the outside surface of the cylinder 20.

The core unit 10 installed in the cylinder 20 of the heating roller 1 includes a fixing shaft 11, an induction coil 13 wound around the fixing shaft 11, and leads 14 and 15 connected to the induction coil 13. The fixing shaft 11 around which the induction coil 13 is wound is formed of a non-magnetic material and has a through hole 18 through the center in the axial direction of the shaft 11. The leads 14 and 15 supplying a high frequency current to the induction coil 13 are wires penetrating from the central through hole 18 to the outer circumference of the fixing shaft 11 and are configured to send a high frequency current from a power source (not shown) to the induction coil 13. The fixing shaft 11 is held with brackets 16 and 17 installed on a side board (not shown) of the fixing apparatus and is not rotative.

In the inside of the cylinder 20, two insulating cylinder members 41 and 42 are provided so as to rotate integrally with the cylinder 20. In this embodiment, the cylinder members 41 and 42 are made of a heat resistant resin, such as for example, polyester resin.

Figure 6:
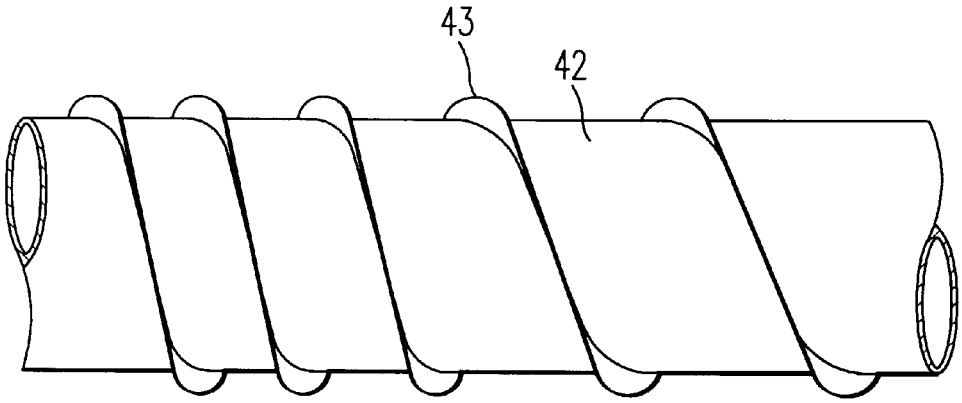
FIG. 6 is a front view illustrating an inner cylinder member having a spiral rib, which is provided inside the heating roller of the fixing apparatus illustrated in FIG. 5.
Figure 7:
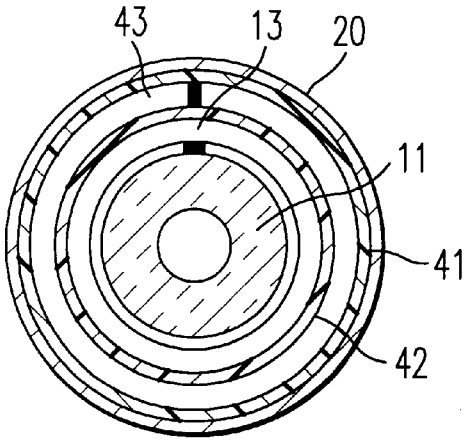
FIG. 7 is a schematic sectional drawing illustrating the heating roller of the fixing apparatus illustrated in FIG. 5.

As illustrated in FIG. 5 and FIG. 7, the outside cylinder member 41 is installed substantially in tight contact with the inner circumference of the cylinder 20 to rotate together with the cylinder 20. On the other hand, the outer circumference of the inner cylinder member 42 has, as illustrated in FIG. 6, a spiral rib 43. The rib 43 is substantially in tight contact with the outside cylinder member 41 and thereby the inner cylinder member 42 also rotates together with the cylinder 20 and the outside cylinder member 41. The width (the length in the axial direction of the shaft 11) of the cylinder members 41 and 42 is made larger than the width (the length in the axial direction of the shaft 11) of the cylinder 20. FIG. 7 is a sectional view of the heating roller 1, in which the cylinder member 41 is installed tightly contacting the inside of the cylinder 20, and the cylinder member 42 having the rib 43 is installed in the inside of the cylinder member 41. Also, the fixing shaft 11 is provided in the inside of the cylinder member 42 and the induction coil 13 is wound around the outer circumference of the fixing shaft 11.

In the fixing apparatus with the above configuration, an induction magnetic flux is generated by supplying a high frequency current to the induction coil 13 of the core unit 10 and an induction current is induced in the cylinder 20, which is made of a magnetic material, by the induction magnetic flux. Joule heat is generated in the cylinder 20 by the induction current and the cylinder 20 is thereby heated. In this embodiment, because the cylinder member 41 is installed substantially tightly contacting the cylinder 20, heat generated in the cylinder 20 does not disperse inside the roller 1 and efficiently conducts to the surface of the cylinder 20, and thereby fixing efficiency can be improved.

As illustrated in the FIG. 2, the heating roller 1 is rotatively driven clockwise in the figure and the pressurizing roller 2 is pressed to the heating roller 1 to be rotated counterclockwise in the figure. A recording sheet S on which a toner image T is loaded for fixing is fed between the heating roller 1 and the pressurizing roller 2 and is conveyed from the right-hand direction to the left-hand direction in the figure, and the toner image T is fixed on the recording sheet S by heat and pressure. In the FIG. 2, illustration has been omitted for the core unit 10 and the cylinder members 41 and 42 inside the heating roller 1.

In the conventional heating roller using an induction heating system, when the heating roller is heated by induction, the temperature of the induction coil may rise gradually due to a radiated heat arrived from the cylinder of the roller up to a temperature to cause breakdown of an insulating film of the coil. In the above embodiment, when the heating roller I is heated by a fixing operation, the temperature of the inside surface of the cylinder 20 rises up to about 180–200° C. and a radiant heat is emitted from the internal surface of the cylinder 20 to the inside of the cylinder 20.

In this embodiment, the resin-made outer cylinder member 41 is installed inside the cylinder 20 tightly contacting the cylinder 20 to insulate the heat radiated by the cylinder 20. Further, the insulating resin-made inner cylinder member 42 is installed in the inside of the outside cylinder member 41 with a 2 mm space between them. As a result, the inside cylinder member 42 is exposed both to heat radiated by the outer cylinder member 41 tightly contacting the cylinder 20 and to heat radiated by the outer cylinder member 41 and conducted through air. In this case, the heat conducted through air is of very low level and a great part of the heat received by the inside cylinder member 42 is radiated heat, and therefore, heat supply to the inside cylinder member 42 is greatly reduced. In addition, because the inside cylinder member 42 is made of an electrically insulating resin, even when the induction coil 13 is broken, an electric current from the coil 13 does not flow to the inside of the apparatus. Thus, temperature rise of the induction coil 13 is suppressed and a defect such as breakdown of an insulating film of the coil 13 can be prevented, and thereby a safe fixing apparatus can be realized.

Furthermore, in the above embodiment, the spiral rib 43 is provided between double cylinder members 41 and 42. The spiral rib 43 with a height of 2 mm is formed integrally with the inner cylinder 42 and then engaged with the outer cylinder member 41 at an engaging part, not illustrated, to rotate integrally with the outer cylinder member 41. Alternatively, as another example, the outer cylinder member 41 may be adhered to fix to the spiral 43 of the inner cylinder member 42 by applying an adhesive to the tip of the spiral 43. On the basis of such structure, the rib 43 is rotated by rotation of the heating roller 1, and thereby air between the cylinder members 41 and 42, which is heated to a high temperature by the heat of the cylinder 20, is exhausted when the rib 43 is rotated. Further, warm air 1 resident in the space between the cylinder members 41 and 42 can be surely sent to an exhausting direction by making the spiral rib 43 to contact respective cylinder members 41 and 42 tightly. Furthermore, as described above, the width of the cylinder members 41 and 42 is larger than the width of the cylinder 20, and by exhausting warmed air between the cylinder member 41 and 42 outside the heating roller 1, cooling efficiency of the heating roller 1 is increased. According to this structure, temperature rise of the induction coil 13 is further prevented and a defect such as breakdown of an insulating film of the coil 13 can be more surely prevented.

The pitch (the axial distance between adjacent ribs) of the spiral rib 43 of the inner cylinder member 42 is not constant, and as illustrated in FIG. 6, in the direction of air flow 20 (from left-hand to right-hand in FIG. 6) which is caused by the rib 43 in rotating the cylinder member 42, an upstream (that is, the entrance side) pitch is made short and a downstream (i.e., the exit side) pitch is made relatively longer. When air flows in the space between the outer cylinder member 41 and the inner cylinder member 42, more heated air flows to the exit side to make the temperature of the cylinder members 41 and 42 higher at the exit side. However, as described above, because the pitch of the rib 43 at the entrance side is made short and the pitch at the exit side is made relatively longer and the volume of air sent by one rotation of the longer pitch is greater than that of the shorter pitch, the temperature rise of the cylinder members 41 and 42 at the exit side is suppressed.

Figure 8:
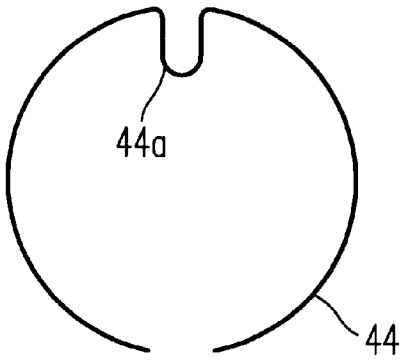
FIG. 8 is a front view illustrating the shape of a stopper to fix the cylinder and the outer cylinder member of the fixing apparatus illustrated in FIG. 5; a FIG. 9 is a partial sectional view illustrating the parts of the cylinder and the outer cylinder member where the cylinder and the outer cylinder member are engaged and fixed.
Figure 9:
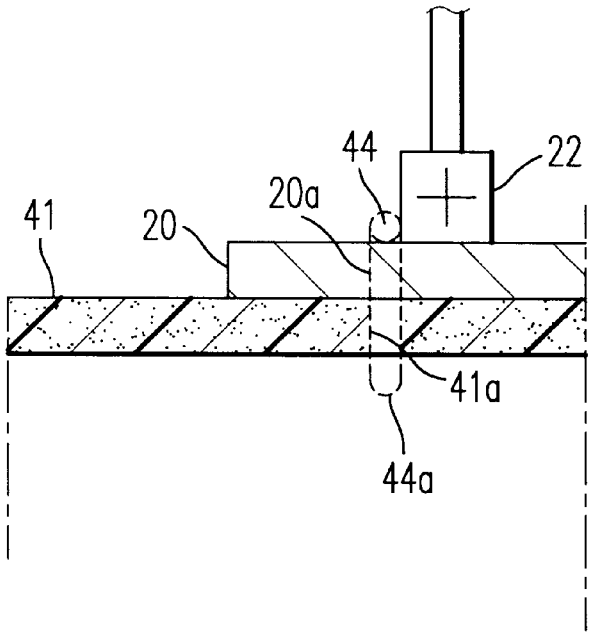

Meanwhile, as illustrated in FIG. 5 and FIG. 9, the cylinder 20 of the heating roller 1 and the outer cylinder member 41 are fixed with a stopper 44. In the above embodiment, the resin-made outer cylinder member 41 has a coefficient of linear expansion larger than that of the cylinder 20, and under a normal temperature, the outer cylinder members 41 can be attachable to and detachable from the cylinder 20, and when heated, the outer cylinder member 41 tightly contacts the cylinder 20. The stopper 44 is shaped, as illustrated in FIG. 8, in a ring shape (with a cut edge) having an internal projection 44*a* in a position of both ends opposite to each other. Further, as illustrated in FIG. 9, the cylinder 20 and the outside cylinder member 41 have cutaway portions 20*a* and 41 a, respectively. The outer cylinder member 41 is inserted into the cylinder 20, respective cutaway portions 20*a* and 41*a* are positioned, the stopper 44 is engaged with the cylinder 20 to engage the projection 44*a* with the cutaway portions 20*a* and 41*a*, and thereby the outer cylinder member 41 and the cylinder 20 are engaged with each other and fixed. In addition, the stopper 44 also works as the thrust stopper for the cylinder 20. That is, as illustrated in FIG. 9, removal of the cylinder 20 to the right direction of the cylinder 20 is prevented by the stopper 44 engaged with the cylinder 20 contacting a bearing 22. The thrust in the opposite direction is stopped, as illustrated in the FIG. 1, by the driving gear 21 fixed to the cylinder 20.

As described above, the thrust of the cylinder 20 is stopped by the stopper 44 engaged with the cylinder 20. Therefore, the cylinder 20 can be easily pulled for removal by removing the stopper 44. Besides, removing the stopper 44 allows release of assemblage of the cylinder 20 with the outside cylinder member 41 and therefore, the cylinder member 41, which is engaged with and in tight contact with the cylinder 20 without use of any adhesive, can be easily removed. Thus, disassembling of the heating roller 1 is made easy and the heating roller 1 as configured above is suitable for recycling.

The present invention has been described so far by way of illustrated embodiments. The invention may be practiced in other forms without departing from the spirit or essential characteristics thereof. For example, a polyester resin is used as the cylinder members 41 and 42 in the above embodiment, but resins and other materials (e.g., a silicon rubber) having a heat resistance against the temperature of the heating roller can be used. It is needless to say that the material used for cylinder members 41, 42 must be a material not heated by induction.

Furthermore, three or more cylinder members can be installed inside the cylinder of the heating roller. In this case, all the cylinder members to be rotated may have spiral ribs, or one or an optional number of cylinder members may have a spiral rib. The rib may be provided in either outside or inside of the cylinder member. For example, in the above embodiment, the rib 43 is provided on the outer circumference of the inner cylinder member 42. However, the rib may be provided on the inner circumference of the outer cylinder member 41. Naturally, ribs can be provided on both the outer and inner circumferences of the inner cylinder member 42. In addition, the height of the rib may be optionally selected. In the above embodiment, the rib 43 provided on the outer circumference of the inner cylinder member 42 is engaged and substantially tightly contacting with the outer cylinder member 41. The height of the rib 43 may be made lower than the distance between the cylinder members. In this case, using the rib is impossible for transmission of the rotation of the cylinder 20 to the inner cylinder member and therefore another connecting member may be used for connection between respective cylinder members.

Further, among a plurality of the cylinder members, only the outermost cylinder member, which is in tight contact with the cylinder 20, may be configured to be rotated integrally with the cylinder 20 and the other inner cylinder member not be rotated. For example, in the above embodiment, the outer cylinder member 41 tightly contacts the cylinder 20 and thus, naturally rotates integrally with the cylinder 20. A spiral rib is provided on the inner circumference of the outer cylinder member 41 and the height of the rib is adjusted to a height not reaching the inner cylinder member 42. In this case, the inner cylinder member 42 is fixedly installed to inhibit rotation following the cylinder 20 (and the outer cylinder member 41). Heated air between the cylinder members 41 and 42 is exhausted to the outside of the roller 1 by rotation of the spiral rib provided on the surface of the inner circumference of the outer cylinder member 41. Also, temperature rise of the induction coil 13 can be prevented by heat insulation by the inner fixed cylinder member 42. When three or more cylinder members are installed inside the cylinder 20 of the roller 1, not only the cylinder member tightly contacting the cylinder 20, but also an optional number of cylinder members can be configured so as to be rotated integrally with the cylinder 20. In this case, the spiral rib can be used for transmission of rotation of the cylinder 20 to the inner cylinder members or another connector member may be installed.

Also, a heat-insulating effect is also yielded when only the outermost cylinder member tightly contacting the cylinder 20 is installed. If the spiral rib is provided on the inner surface of the cylinder member, temperature rise of the induction coil can be suppressed by exhausting heated air inside the roller 1 by way of the spiral rib. Naturally, combined use with other cylinder member increases the suppressing effect on temperature rise of the induction coil.

As described above, in a fixing apparatus having a heating roller using an induction heating system according to the preferred embodiments of the present invention, the insulating member installed between the cylinder of the heating roller, which is the heating unit of the fixing apparatus, and the induction coil can reduce an effect of a heat radiated from the cylinder of the roller on the induction coil and also prevent flowing of heated air inside the roller to the induction coil. Therefore, temperature rise of the induction coil can be surely prevented.

Further, installing a heat absorbing member on the outer surface of the insulating member can reduce the effect of the heat radiated from the cylinder of the roller on the induction coil by absorbing the heat radiated by the cylinder of the heating roller.

Furthermore, a plurality of holes opened in a tubular member, around which the induction coil is wound, and connecting the outer circumferential surface of the tubular member to the outside of the heating roller allows cooling the induction coil and preventing the temperature rise of the induction coil when the heating roller is heated.

The insulating cylindrical member installed substantially tightly contacting the inside of the cylinder of the heating roller prevents dispersion of a heat generated by the cylinder in the inside of the roller and allows efficient conduction of the heat to the surface of the cylinder to improve fixing efficiency.

Furthermore, provision of at least one additional insulating cylinder member inside the insulating cylinder tightly contacting the cylinder improves insulation of the heat from the cylinder and can further suppress the temperature rise of the induction coil.

Still furthermore, the outer insulating cylinder member tightly contacting the cylinder and the inner insulating cylinder member provided inside the outer insulating cylinder member that are longer than the cylinder allows sending air heated by the cylinder to the outside of the heating roller efficiently and suppressing the temperature rise of the induction coil.

The spiral rib provided on the outer insulating cylinder member tightly contacting the cylinder and the rotative insulating cylinder member provided inside of the outer insulating cylinder member allows exhausting heated air in the inside of the roller to the outside of the roller by the rotation of the heating roller, cooling the inside of the heating roller efficiently, and preventing more surely the temperature rise of the induction coil.

The fixing apparatus according to the preferred embodiments of the present invention as described above can be applied in various types of image forming apparatus, including for example a copying machine, a printer, a facsimile and the like.

Figure 10:
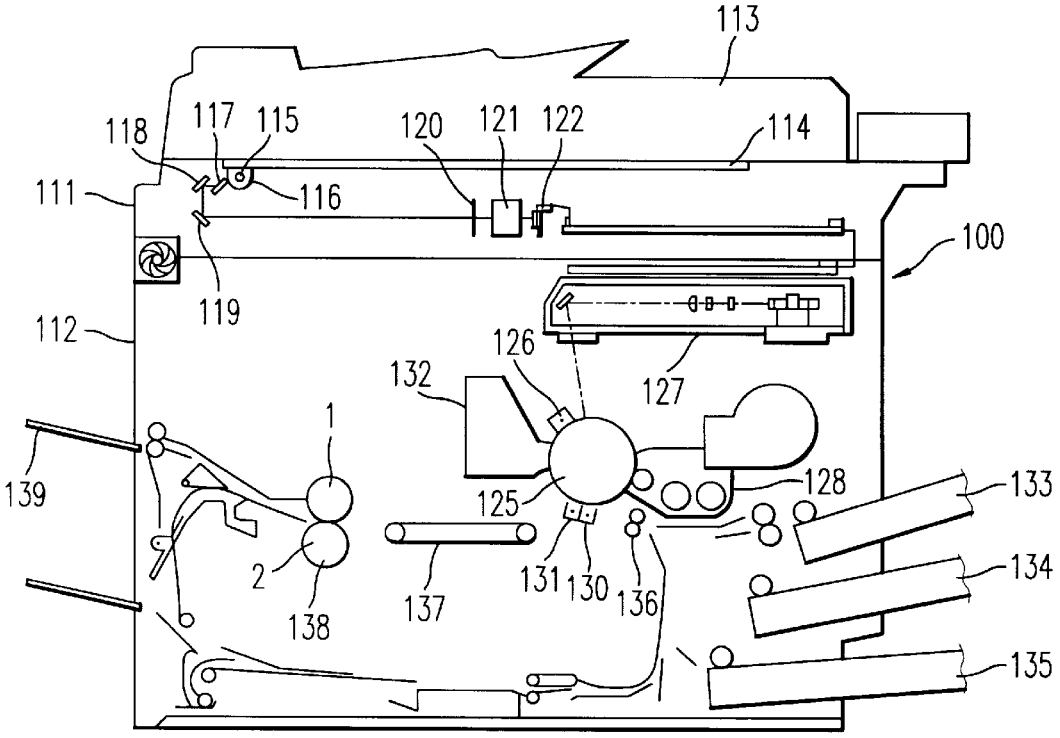
FIG. 10 is a schematic drawing illustrating an image forming apparatus according to an embodiment of the present invention.

FIG. 10 illustrates a digital copying machine as an exemplary construction of an image forming apparatus according to the present invention, using a fixing apparatus having a heating roller using an induction heating system.

In FIG. 10, a digital copying machine 100 includes an image reading device 111, a printing device 1 12 and an automatic document feeding device 113. The automatic document feeding device 113 separates each of the original document sheets set in the automatic document feeding device 113 from each other one by one and feeds the separated original document sheet on a contact glass 114 so as to be positioned in a reading position.

The original document on the contact glass 114 is lighted by way of the illuminating lamp 115 and the reflecting mirror 116, and the light reflected by the original document is imaged on a charge-coupled device (CCD) 122 by a lens 121 via the first mirror 117, the second mirror 118, the third mirror 119, and a color filter 120. The CCD 122 converts the 5 received light image to electrical signals and outputs analogue image signals representing the read image of the original document.

The analog image signals outputted from the CCP device 122 are converted into digital image signals by an analog-to-digital converter (not shown). When an image is formed in the printing device 112, after a photoconductor drum 125 as an image carrier is driven by a drive unit (not shown) and the surface of the photoconductor drum 125 is uniformly charged by a charging device 126, the above digital image signals are sent to a semiconductor circuit board (not shown) and a latent image is formed on the surface of the photoconductor drum 125 according to the digital image signals with an image exposure operation performed by a laser beam scanning device 127.

The latent image on the photoconductor drum 125 is then developed with toner to a visible toner image by a developing device 128. A recording sheet is fed to a registration roller 136 from a selected one of sheet cassettes 133, 134 and 135 and is fed toward the photoconductor drum 125 at a timing to register the leading edge of the recording sheet with the leading edge of a toner image formed on the surface of the photoconductor drum 125. 20 The toner image on the photoconductor drum 125 is transferred onto the recording sheet with a transfer device 130. The recording sheet carrying the toner image is separated from the photoconductor drum 125 with a separating device 131 and is conveyed by a conveying device 137 to a fixing apparatus 138, where the toner image is fixed onto the recording sheet. The recording sheet carrying the fixed toner image is then discharged onto an exit tray 139. The surface of the photoconductor drum 125 is cleaned with a cleaning device 132 after the recording sheet is separated such that residual toner is removed from the surface of the photoconductor drum 125.

In FIG. 10, the fixing apparatus 138 includes a pressurizing roller 2 and a heating roller 1 configured as described above and as illustrated in FIG. 1 or in FIGS. 3 to 9. The heating roller 1 is rotatively driven clockwise in the drawing and the pressuring roller 2 is pressed to the heating roller 1 to be rotated counterclockwise in the drawing. The recording sheet carrying a toner image thereupon is fed between the heating roller 1 and the pressurizing roller 2 and thereby the toner image is fixed on the recording sheet. In FIG. 10, illustration has been omitted for the core unit 10, the insulating unit 30 and other elements inside the heating roller.

Numerous additional modifications and variations of the present invention are possible in light of the above teachings. It is therefore to be understood that within the scope of the appended claims, the present invention may be practiced otherwise that as specifically described herein.

What is claimed as new and desired to be secured by Letters Patent of the United States is:

1. In an induction heating fixing apparatus, the improvement comprising:

a heating roller including, an outer cylinder, a coil arranged inside said outer cylinder to generate an induction magnetic flux, an insulating member arranged between the outer cylinder and said coil, and a heat-absorbing member provided on an outer surface of the insulating member.

2. In an induction heating fixing apparatus, the improvement comprising:

a heating roller including a tubular member on which a coil is wound to generate an induction magnetic flux, and said tubular member comprising an outer circumferential surface having plural openings which communicate with the outside of the heating roller.

3. In an induction heating fixing apparatus, the improvement comprising:

a heating roller including plural coaxially arranged cylinders including an interior insulating cylinder member substantially tightly contacting an inner circumference of another cylinder, wherein a length of the insulating cylinder member in an axial direction of the insulating cylinder member is longer than a length of the another cylinder of the heating roller in an axial direction of the another cylinder.

4. In an induction heating fixing apparatus, the improvement comprising:

a heating roller including plural coaxially arranged cylinders including an interior insulating cylinder member substantially tightly contacting an inner circumference of another cylinder; and a spiral rib provided on the insulating cylinder member, said spiral rib having an upstream pitch shorter than a downstream pitch in a direction of air flow caused by the rib when the insulating cylinder member is rotated.

5. In an induction heating fixing apparatus, the improvement comprising:

a heating roller including plural coaxially arranged cylinders including an interior insulating cylinder member substantially tightly contacting an inner circumference of another cylinder; and at least one additional insulating cylinder member provided inside the insulating cylinder member.

6. The fixing apparatus according to claim 5, wherein the insulating cylinder member substantially tightly contacting said another cylinder and the at least one additional insulating cylinder member have lengths in respective axial directions larger than a length of said another cylinder in an axial direction of said another cylinder.

7. The fixing apparatus according to claim 5, comprising:

a further cylinder member configured to rotate integrally with said another cylinder and including a spiral rib.

8. In an image forming apparatus, the improvement comprising:

an induction heating fixing apparatus including, a heating roller having an outer cylinder, a coil arranged inside said outer cylinder to generate an induction magnetic flux, an insulating member arranged between the outer cylinder and said coil, and a heat-absorbing member provided on an outer surface of the insulating member.

9. In an image forming apparatus, the improvement comprising:

an induction heating fixing apparatus including, a heating roller including a tubular member on which a coil is wound to generate an induction magnetic flux, and said tubular member comprising an outer circumferential surface having plural openings which communicate with the outside of the heating roller.

10. An image forming apparatus comprising:

an induction heating fixing apparatus having a heating roller including plural coaxially arranged cylinders, including an interior insulating cylinder member substantially tightly contacting an inner circumference of another cylinder wherein a length of the insulating cylinder member in an axial direction of the insulating cylinder member is longer than a length of said another cylinder in an axial direction of said another cylinder.

11. An image forming apparatus comprising:

an induction heating fixing apparatus having a heating roller including plural coaxially arranged cylinders, including an interior insulating cylinder member substantially tightly contacting an inner circumference of another cylinder; and a spiral rib provided on the insulating cylinder member, said spiral rib having an upstream pitch shorter than a downstream pitch in a direction of air flow caused by the rib when the cylinder member is rotated.

12. An image forming apparatus comprising:

an induction heating fixing apparatus having a heating roller including plural coaxially arranged cylinders, including an interior insulating cylinder member substantially tightly contacting an inner circumference of another cylinder; and at least one additional insulating cylinder member provided inside the insulating cylinder member.

13. The image forming apparatus according to claim 12, wherein the insulating cylinder member substantially tightly contacting the cylinder and the at least one additional insulating cylinder member have lengths in respective axial directions larger than a length of said another cylinder in an axial direction of said another cylinder.

14. The image forming apparatus according to claim 12, comprising:

a further cylinder configured to rotate integrally with said another cylinder and including a spiral rib.

* * * * *